US006148872A

United States Patent [19]

Wahhoud et al.

[11] Patent Number: 6,148,872

[45] Date of Patent: Nov. 21, 2000

[54] METHOD AND APPARATUS FOR DETERMINING THE STARTING TIME OF THE WEFT INSERTION FOLLOWING A SPEED CHANGE OF THE MAIN DRIVE OF A JET LOOM

[75] Inventors: Adnan Wahhoud, Lindau-Bodolz; Ewald Zimmermann, Meerbusch; Herbert Mueller, Kressbronn; Peter Czura, Wangen; Dieter Teufel, Langenargen, all of Germany

[73] Assignee: Lindauer Dornier Gesellschaft mbH, Lindau, Germany

[21] Appl. No.: 09/535,955

[22] Filed: Mar. 27, 2000

[30] Foreign Application Priority Data

Mar. 25, 1999 [DE] Germany ..... 199 13 398

[51] Int. Cl.[7] ..... D03D 47/30; D03D 51/00

[52] U.S. Cl. ..... 139/435.1; 139/370.2

[58] Field of Search ..... 139/435.1, 370.2

[56] References Cited

U.S. PATENT DOCUMENTS

| | | | |
|---|---|---|---|
| 3,989,068 | 11/1976 | Kakinaka | 139/370.1 |
| 4,590,972 | 5/1986 | Sugita et al. | 139/435.1 |

FOREIGN PATENT DOCUMENTS

| | | |
|---|---|---|
| 0 335320 | 10/1989 | European Pat. Off. . |
| 0 501920 | 9/1992 | European Pat. Off. . |
| 0 525514 | 2/1993 | European Pat. Off. . |
| 0 554222 | 8/1993 | European Pat. Off. . |

*Primary Examiner*—Andy Falik
*Attorney, Agent, or Firm*—W. F. Fasse; W. G. Fasse

[57] ABSTRACT

The starting time of a weft thread insertion in a jet loom is automatically adapted to a change in the speed of the main loom drive shaft, in order to assure that the leading end of the weft thread always arrives at the same time at a weft stop motion device at an exit end of a weft insertion channel through the loom shed. For this purpose, the starting time of the weft insertion is advanced when the loom drive shaft rpm is increased and delayed when the rpm is decreased. The advance or delay has reference to a weaving cycle that begins with the opening of a shed and ends when the shed is fully closed. The flight time $\Delta t_F$ of a weft thread through the shed is constant. The adaptation is performed in response to measuring the rotational drive shaft angle $\alpha_{AR}$ at which a weft thread arrives at the weft stop motion device and determining the starting time in such a way that the weft arrival time ($t_2$, $t_4$, $t_6$) always takes place at substantially the same rotational drive shaft angle $\alpha_{AR}$.

12 Claims, 2 Drawing Sheets

RPM
600
400
300
α=0°
α=180°
α=360°
FA t2
αAR =320°
tC
tZ
t0
t1
t2
t3
t4
t5
t6
tVARI.
Δtf = const.
ΔtS
FA t4=FA t2
ΔtF=CONST.
αAR=320°
Δts=const.
t=0
t/MS
50
100
150
200

METHOD AND APPARATUS FOR DETERMINING THE STARTING TIME OF THE WEFT INSERTION FOLLOWING A SPEED CHANGE OF THE MAIN DRIVE OF A JET LOOM

PRIORITY CLAIM

This application is based on and claims the priority under 35 U.S.C. §119 of 199 13 398.0, filed on Mar. 25, 1999, the entire disclosure of which is incorporated herein by reference.

FIELD OF THE INVENTION

The invention relates to a method and apparatus for determining the starting time of a weft insertion following a change in the speed of the main drive of a jet loom.

BACKGROUND INFORMATION

The term "jet loom" as used herein refers generally to looms with a fluid driven weft insertion, and specifically, to air jet looms. During the manufacturing of fabrics on jet looms, the loom drive is subject to speed changes. For example, at the start of the loom the speed of the loom drive increases until the specified or rated speed has been reached. Speed changes also occur as intended changes, for example as a programmed speed change required, for example, when various types of threads or rather yarns are being used in the weaving operation. Speed changes are also required when different weaving operations are being carried out. Some yarn types and weaving operations can be performed or implemented only at certain yarn drawing speeds, in order to avoid weft thread breakage and to achieve a high productivity. Examples of such situations are a slow increase in the speed of the loom drive when weaving from a creel beam, in order to accelerate the yarn spools or creels, and speed changes required for certain weaving operations, for example when transitioning from terry weaving to smooth weaving (border weaving) and vice versa.

European Patent Publication EP 0,554,222 B1 discloses a method of controlling the weft insertion in an air jet loom that permits varying the flight time of the weft thread by correspondingly triggering the auxiliary or relay nozzles in order to keep the thread arrival time within a certain time frame. The known method can also be used when the speed of the loom drive is changed in order to maintain a constant weft thread arrival time.

A disadvantage of the above mentioned known method is, for example, that a much higher tension load is exerted on the weft thread when the loom drive shaft rpm is increased, whereby the thread flight time is necessarily shortened. The shortened thread flight time requires an increase in the compressed air supply to the auxiliary nozzles in order to accelerate the weft thread. This increased tension on the weft thread can damage the threads or can lead to weft thread breakage.

European Patent Publication EP 0,501,920 B1 discloses a weft thread insertion control device in air jet looms that determine the optimal time for the weft insertion, for triggering the nozzles, etc., based on values entered into the loom control by the weaver. A disadvantage of the known method is that the basic parameters that depend, among other things, from the speed of the loom drive, the type of the thread used, etc., must be specified or entered by the weaver manually, based on experience or empirical values.

OBJECTS OF THE INVENTION

In view of the above it is an aim of the invention to achieve the following objects singly or in combination:

- to provide a method for determining a starting time for a weft insertion in response to a change in the speed of the main loom drive of a fluid jet weaving loom;
- to maintain the weft thread flight time constant or the weft thread arrival is held constant at a fixed rotational angle of the main loom drive shaft;
- to bring the starting time of the weft insertion automatically into a predetermined relationship to the speed or rpm of the main loom drive shaft;
- to assure synchronism between the rpm of the main loom drive and the complete weft insertion, even if the rpm should fluctuate and even if the rpm should be changed in a controlled manner;
- to avoid premature and delayed weft insertion starts under all loom operating conditions of the loom; and
- to optimize the volume of weft insertion fluid such as air, while simultaneously reducing the insertion stress applied to the weft threads while still assuring proper weft tensioning.

SUMMARY OF THE INVENTION

The above objects have been achieved by the method according to the invention for determining a starting time of the insertion of a weft thread into a loom shed of a jet weaving loom depending on a change in an rpm of a main drive shaft in said jet weaving loom and within a weaving process beginning with a shed opening and ending with a shed closing, said method comprising the following steps:

(a) maintaining a constant weft thread flight time ($\Delta t_F$) through said loom shed for all speeds (rpm) of said main drive shaft, (b) determining an angular drive shaft position ($\alpha_{AR}$) at which said weft thread shall exit from said loom shed as a function of time (t) to provide a timing control signal, (c) sensing a change in said rpm to provide a trigger signal for applying said timing control signal, and (d) determining with said timing control signal a starting time ($t_1$; $t_2$; $t_3$; . . . $t_W$) of a weft insertion within said weaving cycle in response to said trigger signal.

In a first example embodiment the starting time of the weft insertion is brought into a predetermined relationship to the speed of the loom drive shaft for maintaining a constant weft thread flight time $\Delta t_F$ for all weft insertions at a substantially constant arrival angle $\alpha_{AR}$ of rotation of the loom drive shaft. The loom drive shaft is at its arrival angle $\alpha_{ar}$ position when the weft thread arrives at a weft stop motion device at the exit of the loom shed. This angle is substantially constant if it is, for example, in the range of 320°±10°. The relationship between the starting time of the weft thread insertion and any desired rpm of the main loom drive shaft makes sure that at least the sum of the weft flight time $\Delta t_F$ plus a weft stretching time $\Delta t_S$ is maintained constant. The weft stretching time is defined between the arrival of the weft thread at a weft stop motion device at the shed exit and the full shed closing. Preferably, both $\Delta t_F$ and $\Delta t_S$ are each kept constant at all rpm of the drive shaft. One important advantage of the method according to the invention is that it provides a synchronous operation between the loom drive and the weft thread insertion system, dependent on rpm fluctuations and intended rpm changes. This synchronism includes the weft thread stretching following the weft thread insertion up to the beat by the reed.

In a further embodiment of the invention, the time period of one revolution of the main drive shaft of the loom of a previous or preceding weaving cycle is determined and based on this time value, the time for the starting of the weft insertion is automatically corrected. In other words, the last measured revolution time period for a weft insertion following a previous weft insertion is the basis or the reference time for the starting of the blowing of the main nozzle and of the auxiliary nozzles. As a result of this automatic correction, neither a delay in the start nor an advance or an early start of the weft thread insertion occurs at a specified or rated speed.

If the present method is not applied, the weft thread stretching time would be lengthened when the speed or rpm of the main shaft of the loom is reduced. The results would be an unnecessary consumption of insertion medium, such as pressurized air through the stretch nozzle, and an additional strain on the weft thread. According to the invention, the consumption of the insertion medium is reduced because the time period during which stretching stress is applied to the weft thread is reduced. Stretching stress is here distinguished from transporting stress applied when the weft thread is moved through the shed.

According to the invention, the correction of the starting time of the weft thread insertion is either an advance in time or a delay in time within a weaving cycle that begins with the opening of a shed and ends with the full closing of the shed. The weft thread starting time delay or advance has reference to a point of time when the weaving shed begins to be fully open to its maximal opening at $t_0$. The weft thread insertion time correction is controlled by corresponding programming of the electronic loom control.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figures 1, 2, 3:
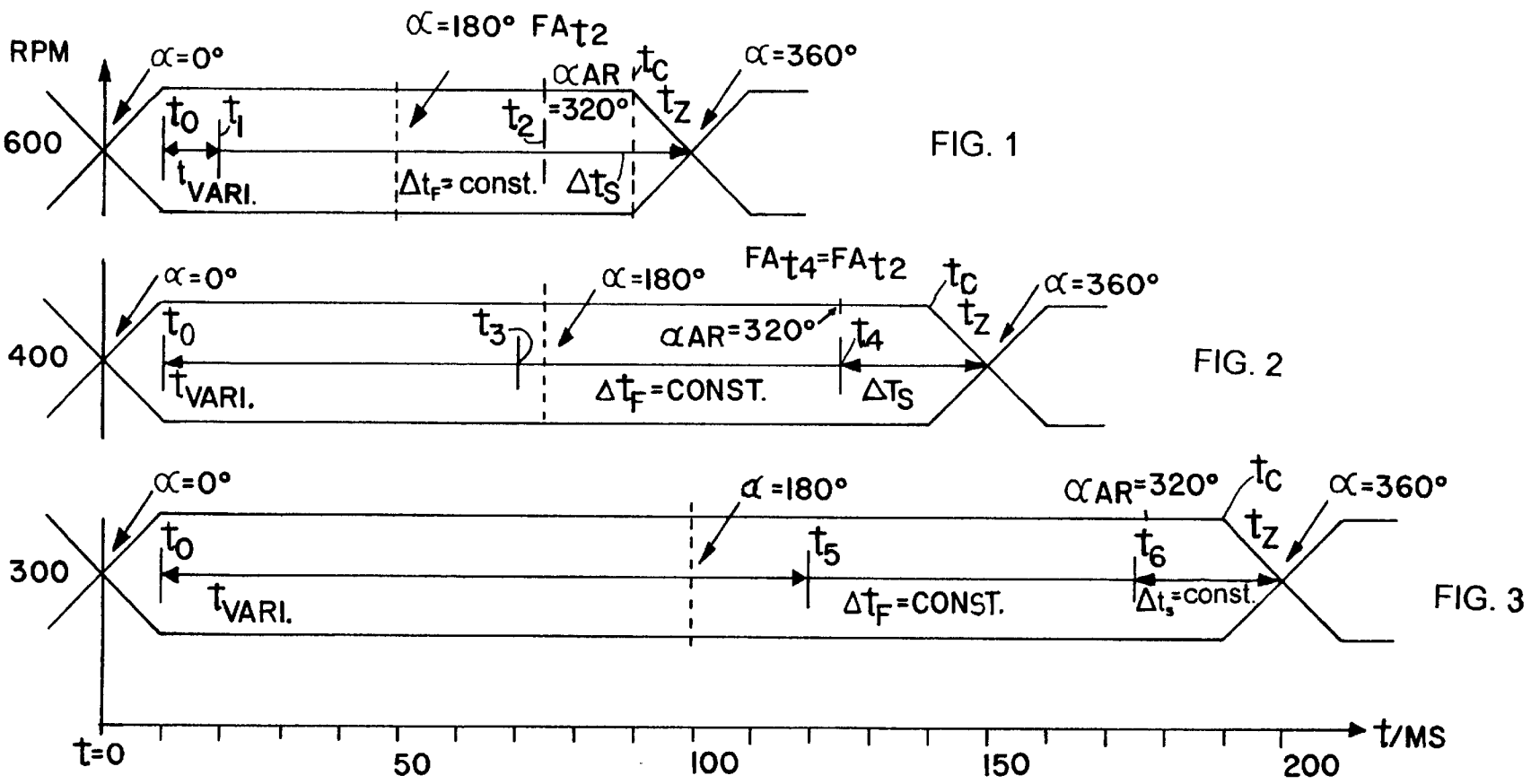
FIG. 1 is a schematic diagram of a weaving cycle between the beginning of a shed opening and full closing of the shed as a function of time at a nominal speed of the loom drive of 600 rpm.
FIG. 2 is a schematic diagram of a weaving cycle at a nominal speed of the loom drive of 400 rpm.
FIG. 3 is a schematic diagram of a weaving cycle at a nominal speed of the loom drive of 300 rpm.

FIGS. 1 to 3 are diagrams of a weaving cycle of a loom operating at three different speeds or rpm of the main loom drive shaft. The time in milliseconds (t) is shown along the abscissa and the speed of the loom in rpm is shown along the ordinate. The drive speeds of 600, 400 and 300 rpm are illustrative examples and are not intended to be limiting. Higher speeds would show similar but shorter loom cycles.

FIG. 1 shows a diagram of a weaving cycle of a loom operating at a nominal speed of 600 rpm The cycle time ($t_Z$) between a $\alpha=0°$ and $\alpha=360°$ is 100 ms, which is measured between the opening of a shed and the closing of the shed. The angle $\alpha$ is the rotation angle of the loom drive shaft. More specifically, the weaving cycle begins at time t=0 when the shed begins to open and ends at time $t_Z=100$ ms when the shed is fully closed. The weaving shed is fully open at $t_0=10$ ms; the shed remains fully open from $t_0=10$ ms to $t_c=90$ ms; and the shed closes from $t_c=90$ ms to $t_Z=100$ ms. The weft insertion begins when the weaving shed is open at time $t_1$ and ends at time $t_2$. The time $t_2$ corresponds to an instantaneous angle of rotation $\alpha_{AR}$ of the main drive shaft of the loom when the weft thread arrives at a weft stop motion sensor positioned at the shed exit, for example $\alpha_{AR}=\alpha t_2=320°$. The thread flight time $\Delta t_F=t_2-t_1=75$ ms−20 ms=55 ms is assumed to be constant. The thread stretching takes place during a time period $\Delta t_S$, between the time $t_2$ when the weft appears at the shed exit and the closing of the shed at time $t_Z$.

FIG. 2 shows an example wherein the speed of the loom drive is decreased from 600 rpm to 400 rpm. In that case, the cycle time increases to $t_Z=150$ ms. According to the invention the weft arrival angle $\alpha_{AR}$ and the thread flight time $\Delta t_F$ are to be held constant, i.e. $\alpha_{AR}=320°$ and $\Delta t_F=t_4-t_3=125$ ms−70 ms =55 ms. The new angle of rotation is then $\alpha_{AR}=\alpha t_4=\alpha t_2=\text{constant}=320°$. The time to of the arrival of the weft thread at the shed exit can be calculated from the speed of the loom drive and the angle of rotation $\alpha$.

Since it is assumed that the thread flight time $\Delta t_F$ is constant, the time of the weft thread insertion $t_3$ at 400 rpm is determined as follows: $t_3=t_4-\Delta t_F$, wherein $t_4$ is the time when the weft exits from the shed. Based on the reduction of the speed from 600 rpm to 400 rpm and maintaining the original angle of rotation $\alpha_{AR}$, the thread stretching time $\Delta t_S$ would increase by a factor of 1.5, if the weft insertion should begin at $t_1$. However, according to the invention, the beginning of the weft insertion is delayed from $t_1$ to $t_3$, whereby $t_{VAR}$ is increased from 10 ms in FIG. 1 to 60 ms in FIG. 2. As a result, $\Delta t_F$ and $\Delta t_S$ remain constant also in the example of FIG. 2.

The extension of the thread stretching time $\Delta t_S$ is a consequence of maintaining a constant weft arrival angle of rotation $\alpha_{AR}$. However, it is not always desirable that the thread stretching time be extended because the weft thread is exposed to unnecessary stretching stress if the stretching time is prolonged. Thus, another example embodiment of the invention provides a method in which the thread stretching time $\Delta t_S$ is also essentially held constant by delaying the starting point of time $t_3$ of the weft insertion, as shown in FIG. 2, whereby $t_{VAR}$ increases as mentioned above.

Such a delay of the weft insertion following the shed opening is particularly desirable at lower speeds of 300 rpm, for example.

FIG. 3 is a diagram of a weaving cycle of a weaving machine operating at a speed of 300 rpm of the main loom drive shaft. The thread stretching time $\Delta t_S$ is to be maintained constant, with reference to the previous speed of 400 rpm. The weft thread arrival time $t_6=t_z-\Delta t_S$ can be calculated from the predetermined value for the thread stretching time $\Delta t_S$, based on the time $t_z$ of the shed closing. Based on the thread flight time $\Delta t_F$ that is assumed to be constant, the delayed time $t_5$ when the weft thread insertion begins is $t_5=t_6-\Delta t_F$.

Figure 4:
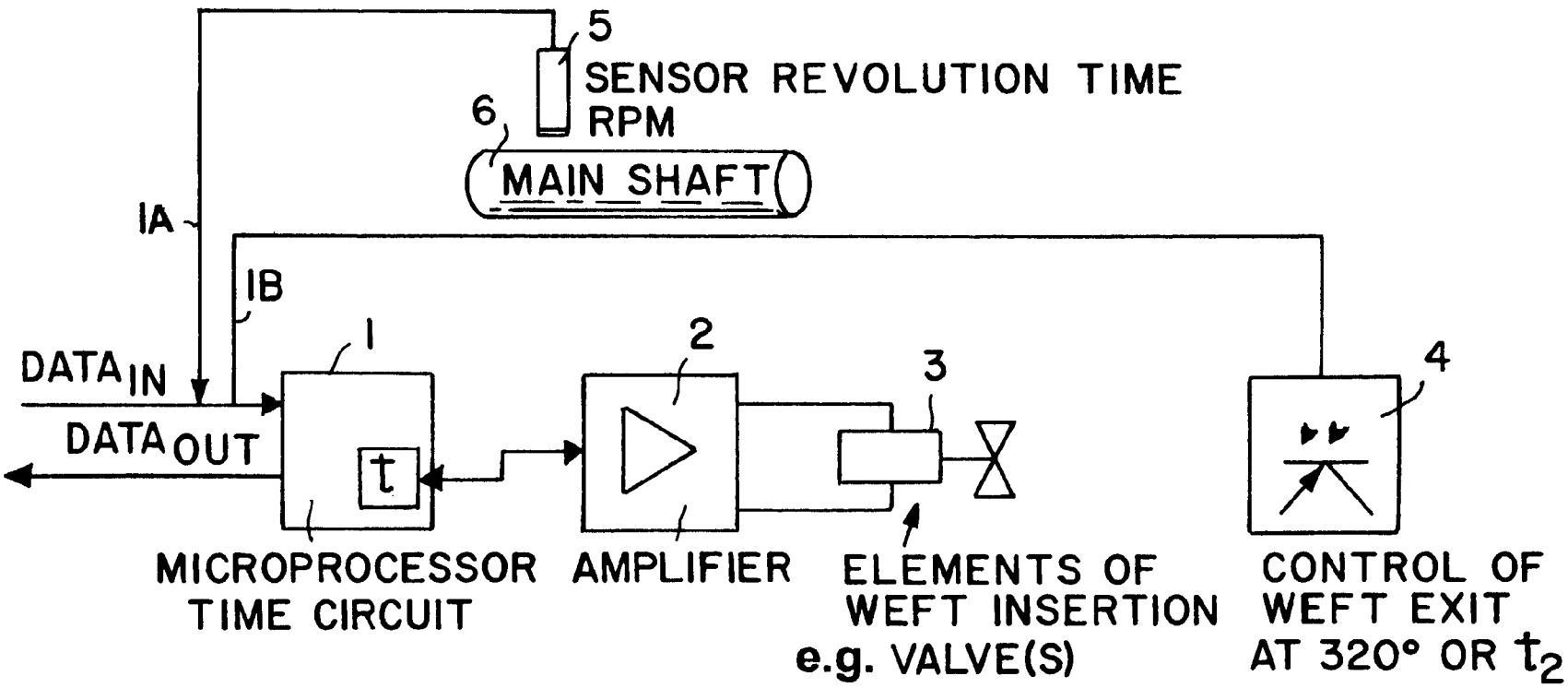
FIG. 4 is a block diagram of a circuit arrangement for performing the present method.

FIG. 4 shows a block circuit diagram of a timing control circuit for determining or controlling the starting time of a weft insertion into a loom shed of a jet weaving loom. A microprocessor 1 has a keyboard for entering operator generated data and further inputs 1A and 1B for receiving input signals. The input 1A is connected to an rpm sensor 5 that measures the speed of a main loom drive shaft 6 to provide a respective speed signal to the microprocessor 1. The other input 1B is connected to a weft stop motion sensor or monitor 4 which provides a signal $\alpha_{AR}$ when the leading end of a weft thread arrives or exits from the loom shed.

The microprocessor 1 includes a timing circuit t for processing the above mentioned two signals into timing control signals that are supplied to weft insertion elements 3, such as magnetically controlled valves for supplying fluid under pressure to jet nozzles not shown. Preferably, an amplifier 2 is connected between the output of the microprocessor 1 and the weft insertion elements.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for determining a starting time of the insertion of a weft thread into a loom shed of a jet weaving loom depending on a change in an rpm of a main drive shaft in said jet weaving loom and within a weaving process beginning with a shed opening and ending with a shed closing, said method comprising the following steps:

(a) maintaining a constant weft thread flight time ($\Delta t_F$) through said loom shed for all speeds (rpm) of said main drive shaft, (b) determining an angular drive shaft position ($\alpha_{AR}$) at which said weft thread shall exit from said loom shed as a function of time (t) to provide a timing control signal, (c) sensing a change in said rpm to provide a trigger signal for applying said timing control signal, and (d) determining with said timing control signal a starting time ($t_1$; $t_2$; $t_3$; . . . $t_W$) of a weft insertion within said weaving cycle in response to said trigger signal.

2. The method of claim 1, further comprising determining a weft stretching time duration ($\Delta t_S$) between said exit of said weft thread from said loom shed and a completion of said shed closing, and maintaining said weft stretching time duration ($\Delta t_S$) substantially constant for all loom operating speeds.

3. The method of claim 2, wherein the sum of $\Delta t_F$ plus $\Delta t_S$ is maintained constant by displacing the starting time ($t_1$; $t_3$; $t_5$; . . . ) respectively.

4. The method of claim 1, further comprising determining a variable time duration ($t_{VAR}$) between a point of time ($t_0$) when said loom shed is fully open and a point of time ($t_1$; $t_3$; $t_5$; . . . ) when a weft thread insertion begins, and shifting said variable time ($t_{VAR}$) in response to said sensing a change in said rpm.

5. The method of claim 4, further comprising increasing said variable time duration ($\Delta t_{VAR}$) in response to sensing a decrease in said rpm.

6. The method of claim 4, further comprising reducing said variable time duration ($\Delta t_{VAR}$) in response to sensing an increase in said rpm.

7. The method of claim 5, further comprising reducing said variable time duration to zero at a point of time ($t_0$), and controlling said starting time to begin at said point of time ($t_0$).

8. The method of claim 7, wherein said point of time ($t_0$) is defined as the time at which said shed is first fully open in any weaving cycle.

9. The method of claim 1, further comprising performing said steps (a) to (d) for each change of said rpm in a sequence of weaving cycles performed in said weaving process.

10. An apparatus for controlling the starting time of the insertion of a weft thread into a loom shed, said apparatus comprising an rpm sensor (5) for sensing the speed of a main loom drive shaft to provide a speed first signal, a weft stop motion sensor (4) for providing a second signal signifying an exit of a weft thread from said loom shed, a microprocessor (1) having an input connected to receive said first and second signals for generating timing control signals in response to said first and second signals, and at least one output for providing said timing control signals, and weft insertion elements having control inputs connected to said at least one microprocessor output for controlling the starting time of said weft insertion elements.

11. The apparatus of claim 10, wherein said microprocessor further comprises an operator data input.

12. The apparatus of claim 10, further comprising an amplifier connected to said microprocessor output and said control inputs of said weft insertion means.

* * * * *

UNITED STATES PATENT AND TRADEMARK OFFICE
CERTIFICATE OF CORRECTION

PATENT NO. : 6,148,872

DATED : November 21, 2000

INVENTOR(S) : Wahhoud et al.

It is certified that error appears in the above-identified patent and that said Letters Patent is hereby corrected as shown below:

| | | |
|---|---|---|
| Col. 4, | line 19, | after "time", replace "to" by --$t_4$--; |
| Col. 5, | line 32, | after "within", replace "said" by --a--; |
| Col. 6, | line 13, | after "claim", replace "5" by --6--. |

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*